US005996674A

United States Patent [19]

Gatewood

[11] Patent Number: 5,996,674

[45] Date of Patent: Dec. 7, 1999

[54] RAPID INSTALLATION CURTAIN

[76] Inventor: Denise D. Gatewood, 1492 Spruce Rdige Way, Stone Mountain, Ga. 30083

[21] Appl. No.: 09/079,996

[22] Filed: May 15, 1998

Related U.S. Application Data

[63] Continuation-in-part of application No. 08/855,706, May 8, 1997, abandoned.

[51] Int. Cl.[6] ..... A47H 13/14

[52] U.S. Cl. ..... 160/348; 160/368.1; 160/113

[58] Field of Search ..... 160/330, 348, 160/368.1, 123, 124, 126, 38, 113

[56] References Cited

U.S. PATENT DOCUMENTS

| | | | |
|---|---|---|---|
| 2,520,613 | 8/1950 | Robertson | 160/330 X |
| 2,528,652 | 11/1950 | Gundlach | 160/348 |
| 2,548,879 | 4/1951 | Druck | 160/330 |
| 2,555,155 | 5/1951 | Rubman | 160/348 |
| 3,297,075 | 1/1967 | Howell et al. | 160/19 |
| 3,433,281 | 3/1969 | Lukashok | 160/330 |
| 3,437,127 | 4/1969 | Lukashok | 160/330 |
| 3,574,887 | 4/1971 | Schindlauer | 16/95 |
| 3,632,154 | 1/1972 | Woodrich | 296/24 |
| 3,753,458 | 8/1973 | Lazarek | 160/354 |
| 3,762,459 | 10/1973 | Stuart | 160/19 |
| 3,777,800 | 12/1973 | Susoev | 160/84 R |
| 3,913,655 | 10/1975 | Ogino | 160/84 R |
| 3,996,987 | 12/1976 | Rodriguez | 160/19 |
| 4,011,696 | 3/1977 | Klein | 52/39 |
| 4,100,957 | 7/1978 | Shelton | 160/368 R |
| 4,114,233 | 9/1978 | Hamilton | 16/95 R |
| 4,222,427 | 9/1980 | Buchner | 160/19 |
| 4,249,589 | 2/1981 | Loeb | 160/368 R |
| 4,333,187 | 6/1982 | Schuler | 4/608 |
| 4,378,043 | 3/1983 | Sorenson | 160/97 |
| 4,436,137 | 3/1984 | Charles | 160/242 |
| 4,610,292 | 9/1986 | Hausmann et al. | 160/120 |
| 4,635,418 | 1/1987 | Hobgood | 52/239 |
| 4,653,566 | 3/1987 | Miale | 160/201 |
| 4,846,244 | 7/1989 | Rosenfeld | 160/201 |
| 4,863,127 | 9/1989 | Handler | 248/205.2 |
| 4,934,439 | 6/1990 | Martin | 160/201 |
| 5,109,912 | 5/1992 | Gary | 160/330 |
| 5,152,331 | 10/1992 | Barone | 160/38 |
| 5,158,127 | 10/1992 | Schumacher | 160/368.1 X |
| 5,191,922 | 3/1993 | Wade | 160/124 |
| 5,271,449 | 12/1993 | Herrick | 160/368.1 |
| 5,313,999 | 5/1994 | Colson et al. | 160/121.1 |
| 5,323,835 | 6/1994 | Bachmeier | 160/89 |
| 5,358,025 | 10/1994 | Wood | 160/368.1 |
| 5,377,740 | 1/1995 | Gilley et al. | 160/348 |
| 5,394,922 | 3/1995 | Colson et al. | 160/121.1 |
| 5,400,848 | 3/1995 | Gainer | 160/238 |

(List continued on next page.)

*Primary Examiner*—David M. Purol

*Attorney, Agent, or Firm*—Barry E. Kaplan, Esq.; Hughes & Kaplan

[57] ABSTRACT

Provided is an improved curtain for garage door windows, standard windows, and the like, with at least one curtain element overlying a support sleeve portion. The support sleeve portion is affixed adjacent the top edge of the curtain element such that the curtain element overlies the support sleeve portion in a smooth fashion and hangs naturally. The support sleeve portion provides for detachably installing the curtain over the window through the use of coacting hook and loop fasteners. The support sleeve portion further provides for rapid adjustment of the width of the curtain, dually through the use of elastic banding material contained within the support sleeve portion, and by crimping and detachably affixing the support sleeve portion to the associated coacting hook portion at selected intervals. The manner and location of affixation of the support sleeve portion allows the curtain to be so rotated through more than ninety degrees relative to the support sleeve portion without causing the curtain to sag or separate from the door when in the raised, overhead position. The curtain may be rolled or folded back upon itself and detachably secured thereto through the use of normally hidden fasteners located within spaced apart pleats of the curtain element.

10 Claims, 3 Drawing Sheets

U.S. PATENT DOCUMENTS 5,417,271 5/1995 Fenley ..... 160/38
5,427,169 6/1995 Saulters ..... 160/368.1
5,597,028 1/1997 Rolf et al. ..... 160/354
5,598,880 2/1997 Cross ..... 160/38
5,598,883 2/1997 Platsis ..... 160/370.23
5,604,961 2/1997 Cole ..... 24/306
5,615,923 4/1997 Madison ..... 296/95.1

RAPID INSTALLATION CURTAIN

CROSS-REFERENCE TO RELATED APPLICATIONS

This is a continuation-in-part of U.S. patent application Ser. No. 08/855,706 filed May 8, 1997, now abandoned.

BACKGROUND OF THE INVENTION

1. Field of the Invention

This invention relates generally to a fabric window covering and, more particularly, to a curtain or drape overlying an adjustable support sleeve portion. The support sleeve portion provides means for rapid installation of the curtain over the window, and for rapid adjustment of the width of the curtain, while, further, allowing the curtain to be rotated through more than ninety degrees relative to the support sleeve portion, all without affecting the otherwise normal appearance of the curtain. To open or store, the curtain may be rolled or folded back upon itself and detachably secured thereto through the use of normally hidden fastening means. This invention is particularly well-suited for use with garage door windows to aid privacy and security, maintain the conditioned air environment, and decorate the window.

2. Description of the Related Art

In homes having a garage, the garage door windows may allow the public to view interior portions of the home. Such uninvited viewing is an invasion of the homeowner's privacy and, potentially, could pose a home security problem. Sometimes, a homeowner may store valuable assets in her garage. In such cases, the garage door windows open to public display all of the valuable property within the garage.

Notwithstanding these considerations, garage door windows often are left bare, and, thereby, the homeowner is left feeling insecure. Sometimes, a homeowner who has concern for such issues may consider hanging material or paper over the windows to cover them and to maintain her privacy. This approach, however, may not prove satisfactory to the homeowner because of the unsightly appearance and inconvenience associated with such a solution.

A homeowner may consider hanging curtains over the garage door windows. Such curtains, however, often must be custom-made, which tends to be costly and time-consuming. Additionally, it may prove impractical to hang curtains by rods in such an environment, because the garage door may be opened several times a day. Because the garage door is opened by being rolled within a track, and due to the vibration associated with such action, after prolonged use, the curtain rod would most likely break away from the garage door or become inconveniently unfastened from it.

Additionally, curtains affixed in such a manner tend to hang awkwardly when the garage door is opened. Over time, and due to repeated opening and closing of the garage door, the curtain, so affixed, tends to bunch and twist non-uniformly upon its rod. In such circumstances, the homeowner must intervene to untangle and straighten the curtain in order to maintain its effective use and continued aesthetically pleasing appearance. Further, curtains affixed in this manner are inconvenient, and sometimes difficult, to open when the homeowner desires to do so.

Mindful of these problems, one might consider hanging the curtain in a different manner than upon a rod. For example, it is known in the art to affix a curtain or partition to a wall or other vertical surface through the use of hook and loop fasteners. Such fasteners are well-known in the trade under various brand names, including Velcro®.

Examples of mounting a curtain or partition according to such means are seen by reference to the following U.S. Pat. Nos. 3,632,154 to Woodrich; 3,753,458 to Lazarek; 3,777,800 to Susoev; 3,913,655 to Ogino; 3,996,987 to Rodriguez; 4,100,957 to Shelton; 4,249,589 to Loeb; 5,271,449 to Herrick; and, 5,427,169 to Saulters.

Such means of affixation, however, do not solve each of the unique problems identified hereinabove with regard to garage door curtains. For example, when the Velcro® is merely placed along the top edge of the standard curtain configuration, the mounted portion of the curtain, under the weight and moment of the hanging portion of the curtain material, and in conjunction with the repeated rotation and vibration of the door during opening and closing, tends to sag and, ultimately, to separate from the door when in the raised, overhead position.

Further, a curtain mounted with Velcro® according to the prior art does not provide convenient means for adjustment of the width of the curtain. Means for adjustment, such as illustrated in U.S. Pat. No. 5,271,449 to Herrick, may not be sufficient to accommodate the range of widths necessary to ensure an adequate fit of the curtain to the window portion of the garage door.

It is apparent that a garage door curtain providing a solution to the above-identified problems may prove useful to the homeowner. Thus, it would be advantageous to provide for the benefit of the homeowner a new and unique curtain which is a functional, secure, convenient to install, adjustable, aesthetically appealing, and cost effective solution to problems of the type just described. It is, therefore, to the provision of such an improved curtain that the present invention is directed.

Accordingly, the several objects of the present invention are:

- to provide an improved curtain which is easily and conveniently installed;
- to provide an improved curtain which is effective in its intended uses for covering garage door windows, conventional windows, bounded open areas, and the like;
- to provide an improved curtain which is convenient and rapid to adjust;
- to provide an improved curtain which is secure, uniform, and aesthetically pleasing in its means of mounting and affixation, even when rotated into an overhead position;
- to provide an improved curtain which does not bunch or twist about its mounting means, even when rotated into an overhead position;
- to provide an improved curtain which is convenient to open and to store;
- to provide an improved curtain which is susceptible of being provided in convenient and conventional sizes;
- to provide an improved curtain which is decorative and aesthetically pleasing in appearance; and,
- to provide an improved curtain which is economical to manufacture.

Other objects, features, and advantages of the present invention will become apparent to those skilled in the art by reference to the drawings and to the detailed description of the preferred embodiment of the invention presented herein.

BRIEF SUMMARY OF THE INVENTION

In accordance with the several objects of the present invention, provided is an improved curtain for garage door windows, standard windows, and the like, comprising at least one curtain or drape element overlying a generally tubular, support sleeve portion. The support sleeve portion is affixed adjacent the top edge of the curtain element, as by stitching, such that the curtain element overlies the support sleeve portion in a smooth fashion and hangs naturally. The support sleeve portion provides means for detachably installing the curtain over the window through the use of coacting hook and loop fasteners, where, for example, the loop portion is affixed to the support sleeve portion, as by stitching, and the hook portion is attached, as by adhesive, adjacent and above the window.

The support sleeve portion further provides for rapid adjustment of the width of the curtain. Such adjustments easily may be made so as to fit the curtain to the desired window dimension, dually through the use of elastic banding material contained within the support sleeve portion, and by providing the support sleeve portion to be crimped and detachably affixed to the associated coacting hook portion at selected intervals. Because adjustment is made with, and adjacent, the support sleeve portion only, the overlying curtain element remains smooth and hangs naturally.

Additionally, the manner and location of affixation of the support sleeve portion allows the curtain to be rotated through more than ninety degrees relative to the support sleeve portion, all without affecting the otherwise smooth and normal appearance of the curtain element. Further, the manner and location of affixation of the support sleeve portion allows the curtain to be so rotated without causing the curtain, under the weight and moment of the hanging portion of the curtain material, and in conjunction with the repeated rotation and vibration of the door during opening and closing, to sag or separate from the door when in the raised, overhead position.

To open or store the curtain, the curtain may be rolled or folded back upon itself and detachably secured thereto through the use of normally hidden fastening means, as through a plurality of coacting portions of hook fastener within spaced apart pleats of the curtain element.

This improved curtain of the present invention is particularly well-suited for use with garage door windows to aid privacy and security, maintain the conditioned air environment, and decorate the window. The curtains of the present invention provide a pleasant look to the outside of the garage or window, as well as provide a finished look to the inside.

Installation of the improved curtain of the present invention may be performed rapidly. Care and maintenance of the curtains easily may be provided by the homeowner so that the curtains are kept clean, fresh, and renewed, as by detaching them from the window mounting surface, laundering, and re-attaching them in the manner provided.

BRIEF DESCRIPTION OF THE DRAWINGS

The invention is better understood by reading the Detailed Description of the Invention with reference to the accompanying drawing figures, in which like reference numerals denote similar structure and refer to like elements throughout, and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE INVENTION

In describing preferred embodiments of the present invention illustrated in the Figures, specific terminology is employed for the sake of clarity. The invention, however, is not intended to be limited to the specific terminology so selected, and it is to be understood that each specific element includes all technical equivalents which operate in a similar manner to accomplish a similar purpose.

Figure 1:
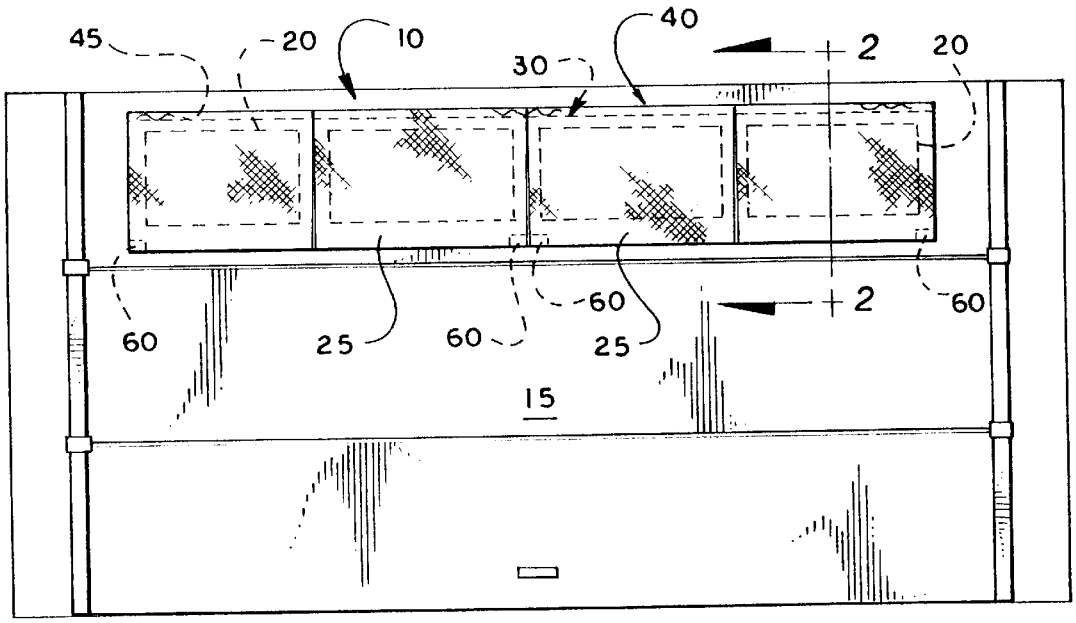
FIG. 1 is an elevation view of the garage door curtain of the present invention as it is mounted to the inside of the garage door.

Shown in FIG. 1 is the preferred embodiment of the improved curtain 10 of the present invention, installed upon the inside of a typical garage door 15. The curtain 10 is installed adjacent the windows 20 of the garage door 15. The curtain 10 may be constructed of any of a variety of fabrics well-known in the art, either opaque, like a drape, or transparent, like a sheer. The curtain 10 also provides an aesthetically finished look to both the inside and the outside of the garage or room.

Preferably, the curtain 10 is manufactured according to one or more standard sizes. In that regard, it is observed that many double car garage doors have windows measuring from 186×19½ inches, for 16 foot garage doors, to 210×19½ inches, for 18 foot garage doors. In accordance with these dimensions, it is preferred that the curtain of the present invention be provided in standard widths of 93×19½ inches to 105×19½ inches. Thus, provided according to such dimensions, two curtains are used for a double car garage, and a single curtain is used for a single car garage.

Figure 2:
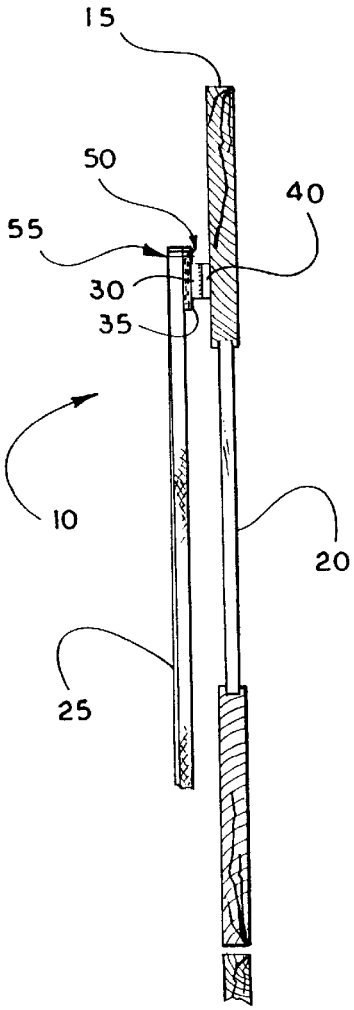
FIG. 2 is an enlarged side view in partial cross-section of the garage door curtain of the present invention, taken along line 2—2 of FIG. 1.

FIGS. 1 and 2, therefore, depict the garage door curtain 10 of the present invention having a width of 93×19½ inches. Two, identical panels, or curtain elements 25, each are suspended by a preferably continuous piece of loop tape 30, which is sewn along the entire length of the top portion of each curtain 10, adjacent the mounting surface provided by a support sleeve element 35. A preferably continuous piece of hook tape 40 is mounted, as by adhesive, adjacent and above the windows 20 of the garage door. The hook tape 40 is located so as to cooperatively and detachably engage the loop tape 30 of the curtain 10.

Figure 3:
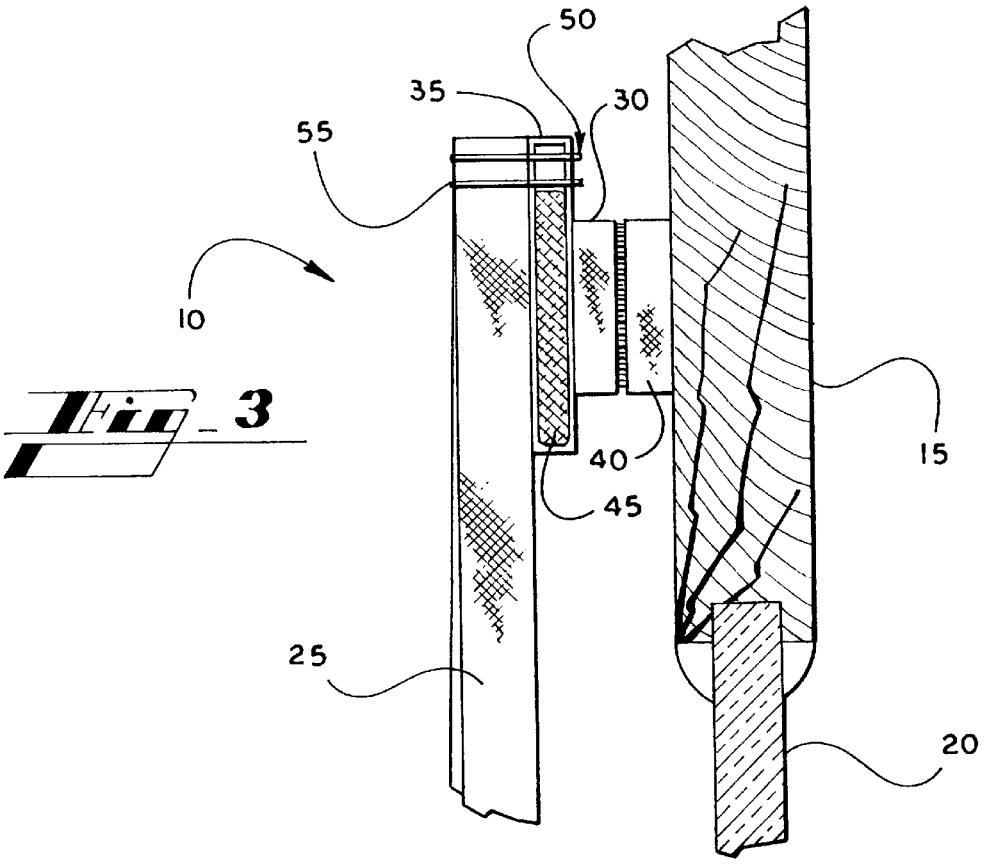
FIG. 3 is an enlarged sectional view of the garage door curtain of the present invention, taken according to FIG. 2, and showing the support sleeve portion containing an elastic member.

As best seen by reference to FIGS. 2 and 3, curtain 10 is assembled by folding the curtain material over, parallel to its top edge, so that a tubular, support sleeve element 35 is formed. Within the support sleeve element 35 is stitched, in a manner well-known in the art, a segment of elastic banding material 45. The support sleeve element 35 is completed, typically, by stitching along seam 50. The support sleeve element 35 is then folded over, again parallel to its top edge, and stitched along seam 55. It can readily be seen that the curtain 10, fabricated according to this manner, tends to hinge about seam 55. This is especially advantageous to the invention for the reasons explained more fully hereinbelow, read in conjunction with reference to FIG. 4.

The width of curtain 10 may be adjusted by stretching or contracting support sleeve element 35 according to its elastic banding 45 and detachably affixing it, via loop portion 30, to the associated coacting hook portion 40. Alternatively, or additionally, the support sleeve element 35 may be crimped, in a manner well-known in the art, detachably affixed, via loop portion 30, to the associated coacting hook portion 40 at selected intervals. Because selected width adjustments are made with, and adjacent, the support sleeve element 35 only, the overlying curtain element 25 remains smooth and hangs naturally.

Figure 4:
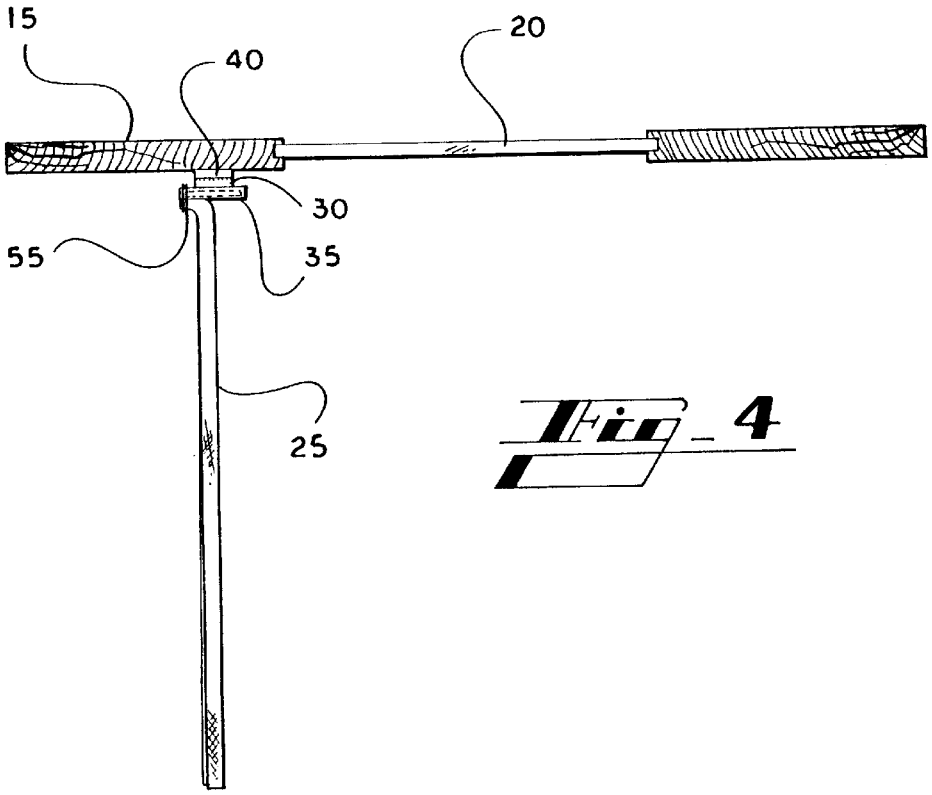
FIG. 4 is an enlarged sectional view of the garage door curtain of the present invention, taken according to FIG. 2, but rotated into the overhead position; and, FIG. 5 is a perspective elevation view of the garage door curtain of the present invention, demonstrating the curtain being opened in its intended manner.

As best seen with reference to FIG. 4, the support sleeve element 35 provides for stable and secure affixation of the curtain 10 to the mounting surface or door 15, and for rotation of the curtain 10 through more than ninety degrees as the garage door 15 is raised into an overhead position. Because the support sleeve portion 35 is stitched parallel to the top edge of the curtain 10, but offset below that edge, the curtain element 25 tends to rotate, or hinge, about seam 55. Because this rotation occurs at a location more proximate to the center of the hook 40 and loop 30 fastening elements than otherwise provided in the prior art, the moment upon those fastening elements is thereby reduced. In this manner, curtain 10 has a reduced tendency to separate or sag from the mounting surface as the door 15 repeatedly is rotated, with attendant vibration, between its open and closed positions.

Optionally, curtain 10 may be provided with additional, spaced apart portions of coacting hook and loop fastening elements, located along the bottom edge of the curtain and the adjacent door or wall, as at locations 60. So provided, the coacting hook and loop fastening elements detachably affix the bottom edge of the curtain 10 to the door or wall surface for an aesthetically pleasing, smooth appearance, or to prevent the curtain element 25 from hanging vertically, in the manner as shown in FIG. 4, when the door is raised in the overhead position.

Figure 5:
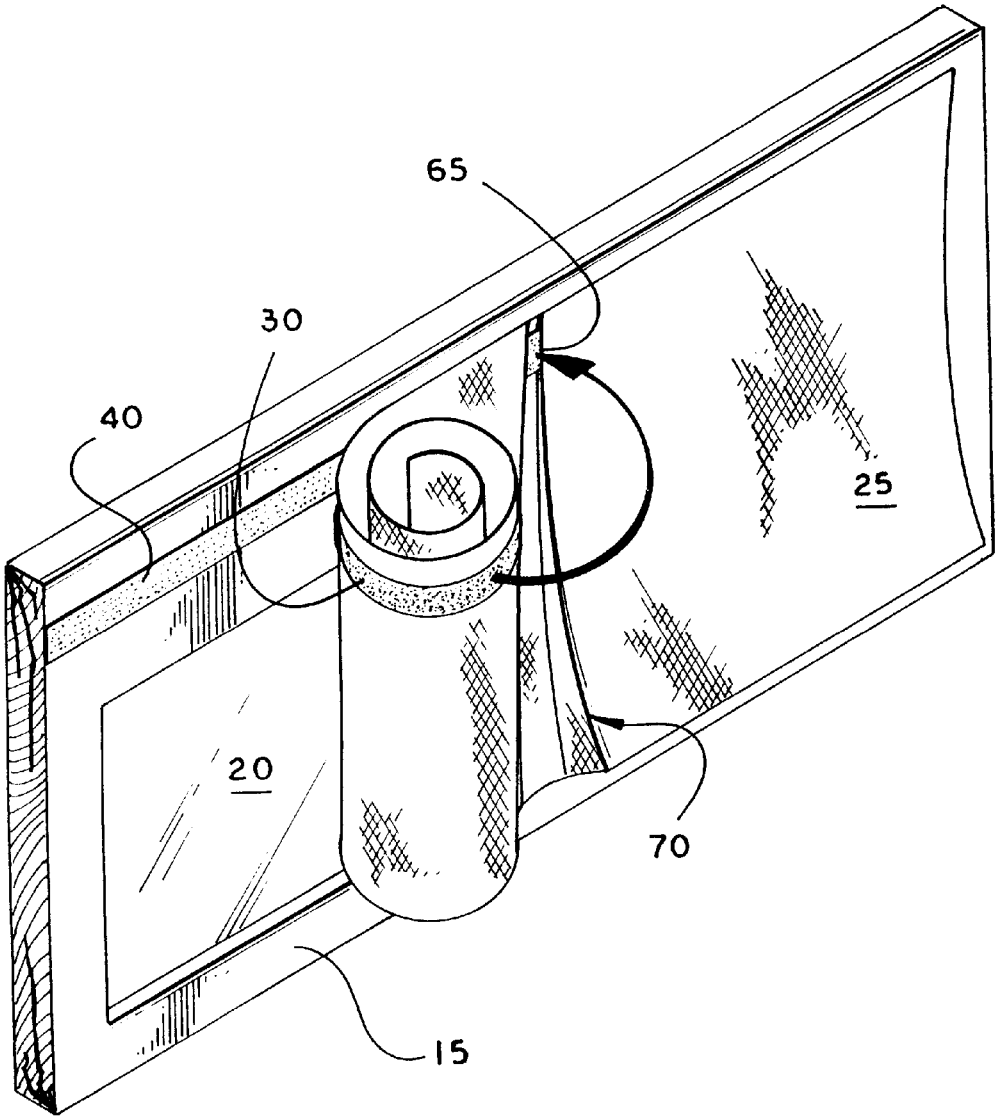

Optionally, curtain 10 may be provided with a plurality of spaced apart portions of coacting hook elements 65, preferably hidden from normal view by locating the individual hook elements 65 within spaced apart pleats 70 of the curtain element 25. Curtain 10, so provided in this fashion, conveniently may be opened or stored by rolling or folding the curtain 10 back upon itself so that the loop tape 30 is detachably secured to the plurality of spaced apart hook elements 65 in the manner illustrated in FIG. 5.

Installation of the improved curtain of the present invention may be performed rapidly. Care and maintenance of the curtains easily may be provided by the homeowner so that the curtains are kept clean, flesh, and renewed, as by detaching them from the window mounting surface, laundering, and re-attaching them in the manner provided.

Although not preferred, it will be appreciated by those ordinarily skilled in the art, that either or both of the loop tape portions 30 or the hook tape portions 40 may be provided in a plurality of segments, rather than as continuous elements. It will further be appreciated by those ordinarily skilled in the art, that the loop tape portions 30 or the hook tape portions 40, or their equivalents, may be reversed from the configuration specified herein without departing from either the scope or spirit of the present invention. Although not preferred, it will be appreciated by those ordinarily skilled in the art, that the function of the coacting hook and loop portions specified hereinabove may be provided by substituting their functional equivalents, as, for example, snap elements.

Having thus described preferred embodiments of the present invention, it should be noted by those skilled in the art that the within disclosures are exemplary only and that various other alternatives, adaptations, and modifications may be made within the scope of the present invention. For example, changes in structure, fabrics, materials, sizes, and shapes can be made by those ordinarily skilled in the art without departing from either the scope or spirit of the present invention. Accordingly, the present invention is not limited to the specific embodiments as illustrated herein, but is only limited by the following claims.

I claim:

1. A curtain for hanging upon a vertical surface, such as a garage door or wall, said vertical surface having at least one window, the curtain comprising:

a. a fabric member comprising a curtain element, said curtain element having a top edge, a bottom edge, opposing side edges, a front portion, and a back portion;

b. a support sleeve element affixed by a seam to said curtain element adjacent to said back portion and below said top edge, said seam disposed approximately one-eighth to one-half of the height of said support sleeve element from said top edge, the support sleeve traversing substantially the width of said curtain approximately parallel with said top edge, the curtain element depending from said seam and being free to rotate about said seam, the curtain element being further disposed freely to overlay the support sleeve element when mounted upon a vertical surface;

c. two part hook and loop fastening means for cooperatively and detachably affixing said support sleeve element to said vertical surface, a first part of said two part hook and loop fastening means being affixed to said vertical surface, a second part of said two part hook and loop fastening means being affixed to said support sleeve element, such that said two part hook and loop fastening means may be cooperatively engaged with one another;

d. a spaced apart pleat along said front portion; and, e. a hook portion of a hook and loop fastening means substantially hidden within said pleat, such that the curtain may be rolled or folded upon itself to bring a loop portion affixed to said support sleeve element into cooperative engagement with said hook portion and thereby to hold the curtain partially open relationship to said window, whereby the at least one window may be substantially covered by said curtain.

2. The curtain of claim 1, wherein the support sleeve element may be rotated through approximately ninety degrees relative to the back portion of said curtain element without substantially disturbing the front portion of said curtain element.

3. The curtain of claim 1, having means for adjusting the width of said curtain.

4. The curtain of claim 3, wherein said means for adjusting the width of said curtain comprises at least one segment of elastic banding material affixed within said support sleeve element.

5. The curtain of claim 3, wherein said means for adjusting the width of said curtain comprises crimping said support sleeve element prior to cooperatively and detachably affixing said support sleeve element to said vertical surface.

6. A curtain for hanging upon a garage door having at least one window, the curtain comprising a fabric member having a curtain element, said curtain element having a top edge, a bottom edge, opposing side edges, a front portion, and a back portion; a support sleeve element affixed by a seam to said curtain element adjacent said back portion and below said top edge, said seam disposed approximately one-eighth to one-half of the height of said support sleeve element from said top edge, the support sleeve traversing substantially the width of said curtain approximately parallel with said top edge, the curtain element tending to depend from said seam and being free to rotate about said seam, the curtain element being further disposed freely to overlay the support sleeve element when mounted upon a vertical surface; hook and loop fastening means for cooperatively and detachably affixing said support sleeve element to said vertical surface, said hook means being affixed to said vertical surface, and said loop means being affixed to said support sleeve element, such that said hook and loop fastening means may be cooperatively engaged with one another whereby the at least one window may be substantially covered by said curtain; a spaced apart pleat along said front portion; and, a hook portion of a hook and loop fastening means substantially hidden within said pleat, whereby the curtain may be rolled or folded upon itself to bring a loop portion affixed to said support sleeve element into cooperative engagement with said hook portion and thereby to hold the curtain in partially open relationship to said window.

7. The curtain of claim 6, wherein the support sleeve element may be rotated through approximately ninety degrees relative to the back portion of said curtain element without substantially disturbing the front portion of said curtain element.

8. The curtain of claim 6 having means for adjusting the width of said curtain.

9. The curtain of claim 8, wherein said means for adjusting the width of said curtain comprises at least one segment of elastic banding material affixed within said support sleeve element.

10. The curtain of claim 8, wherein said means for adjusting the width of said curtain comprises crimping said support sleeve element prior to cooperatively and detachably affixing said support sleeve element to said vertical surface.

* * * * *